United States Patent [19]

Wens

[11] 4,213,754

[45] Jul. 22, 1980

[54] SYSTEM FOR SEALING THE ROTARY TUBE OF A ROTARY TUBULAR KILN

[75] Inventor: Johannes C. Wens, Nijmegen, Netherlands

[73] Assignee: Smit Ovens Nijmegen B.V., Nijmegen, Netherlands

[21] Appl. No.: 941,982

[22] Filed: Sep. 13, 1978

[30] Foreign Application Priority Data

Sep. 16, 1977 [DE] Fed. Rep. of Germany ..... 2741738

[51] Int. Cl.[2] ..... F27B 7/24

[52] U.S. Cl. ..... 432/115; 34/242

[58] Field of Search ..... 432/103, 115, 242; 34/242

[56] References Cited

U.S. PATENT DOCUMENTS 3,463,468 8/1969 Hobbs ..... 432/115

FOREIGN PATENT DOCUMENTS 905278 11/1945 France ..... 432/115

*Primary Examiner*—John J. Camby

*Attorney, Agent, or Firm*—Fitch, Even, Tabin, Flannery & Welsh

[57] ABSTRACT

A system for sealing the rotary tube of a rotary tubular kiln relative to the casing at inlet and outlet portions with first packings which contact radially extending sealing surfaces, as well as second packings abutting axially extending sealing contact surfaces, as well as at least one sealing ring element receiving said second packings and arranged in concentric relation to said rotary tube, said sealing ring element having a certain degree of axial and radial freedom of movement and being provided with mounting means taking up the weight of said sealing ring element including the weight of said packings, and said sealing ring element being urged in the axial direction, when mounting said first packings, against a sealing contact surface mounted stationarily to said casing, or against said packings secured to said casing.

5 Claims, 5 Drawing Figures

SYSTEM FOR SEALING THE ROTARY TUBE OF A ROTARY TUBULAR KILN

Figure 1:
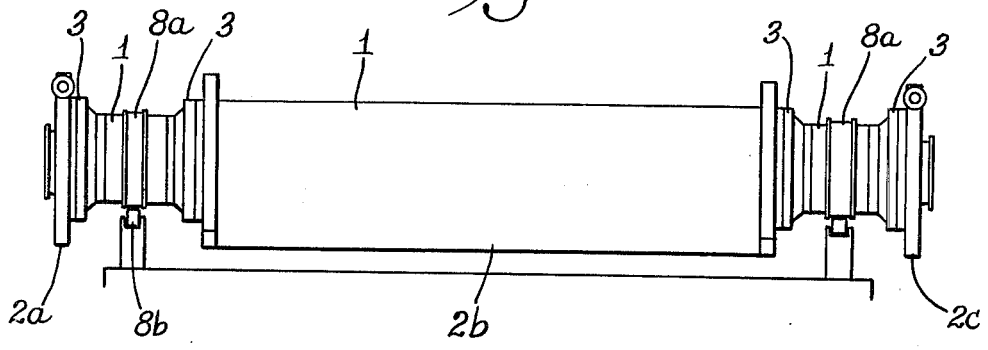

The present invention relates to a system for sealing the rotary tube or cylinder of a rotary tubular kiln relative to the casing at inlet and outlet portions as well as at the combustion chamber by means of sealing packings of heat resistant and slidable material.

Rotary or revolving tubular kilns of the abovementioned type have been in wide spread use for a long time; such kilns are used, for instance, for the production of cement, for the drying of the most varied materials and for the combustion of hard-to-burn mixtures, such as household or special refuse. The present system for sealing the rotary tube or cylinder relative to the casing is suitable for all types of rotary tubular kilns; preferably, however, this system is used in rotary tubular kilns for the processing or combustion of refuse. In the processing of refuse, gaseous components are released which must be discharged and which, in part, may be re-used as combustion gas. Accordingly, the invention is particularly based upon the object of sealing both the combustion chamber and the inlet and outlet sections during rotation of the cylinder. The gaseous components produced partially contain substantial quantities of contaminants and toxic constituents, e.g. fluor, such that efficient sealing is of utmost importance in order to avoid harmful emissions.

The solution to this problem is complicated by the fact that units of increasing dimensions are employed with the progress in the art, with the sealing problems increasing in overproportional manner with the great diameters required in such units. Besides, the axial and radial expansion of the cylinder, being heated to about 1000° C., as compared to the cold condition thereof, must be accommodated.

Accordingly, it is the object of the present invention to provide an improved sealing system for rotary tubular kilns for use between the rotary tube or cylinder and the various casing or housing sections, which system provides for absolutely safe or secure sealing with a low rate of wear, and which system is failuresafe while requiring little maintenance and, at the same time, not affecting the efficiency of the rotary tubular kiln construction.

According to the invention, this object is solved in that there are provided first packings which contact radially extending sealing contact surfaces, as well as second packings abutting axially extending sealing contact surfaces, as well as at least one sealing ring element receiving said second packings and arranged in concentric relation to said rotary tube or cylinder, said sealing ring element having a certain degree of axial and radial freedom of movement and being provided with mounting means taking up the weight of said sealing ring element including the weight of said packings, and said sealing ring element being urged in the axial direction, when mounting said first packings, against a sealing contact surface mounted stationarily to said casing, or against said first packings secured to said casing.

In particular, in order to provide some degree of movability (play) so as to increase the sealing effect and to reduce wear, the construction may be made in such a way that said first packings being pressed against the radially extending sealing contact surface or being secured to said casing, are retained within a ring, and that said second packings being pressed against the peripheral surface concentric with the cylinder axis are retained within another ring, with said ring either pressing into contact the ring retaining said first packings or, in the case of stationary first packings, defining said sealing contact or counter surface.

The simplest design involves that said rings are not rotatable with said cylinder and are pressed against said radially extending, stationary sealing contact surfaces, and that the weight of said rings is taken up by cables passing across sheaves, which cables engage a pair of bolts of said sealing ring element oppositely arranged on a horizontal plane.

In order to provide a sealing effect both with respect to the combustion chamber and with respect to inlet and outlet (discharge) sections, preferably the design may be such that each end of said cylinder has arranged therein a pair of sealing ring elements providing pressure forces acting in opposition to each other, with one sealing ring element each acting against said combustion chamber and the other element acting against said inlet portion or said outlet portion, respectively. Thus, a pair of sealing ring elements each are present at both ends of the kiln.

In order to minimize wear of the packings being concentrically aligned with the cylinder axis, and to avoid disturbance of the sealing effectiveness by possible deformation and inaccuracy of the cylinder, it is possible that said peripheral sealing surfaces of said cylinder disposed in concentric relation to the cylinder axis are defined by the outer faces of rings arranged concentrically with respect to said cylinder, said rings being thermally insulated relative to said cylinder and connected thereto in gas-tight fashion and elastically or resiliently to some degree. In particular, each ring may have a conical portion the wall thickness of which is substantially smaller than in the cylindrical portion thereof, and which allows for, and absorbs, slight any positional variation and particularly thermally induced increase in circumferential length of the cylinder. This design provides a sealing surface which is always parallel to the sealing packings and which is unaffected by the cylinder surface subjected to high temperature.

Figure 3:
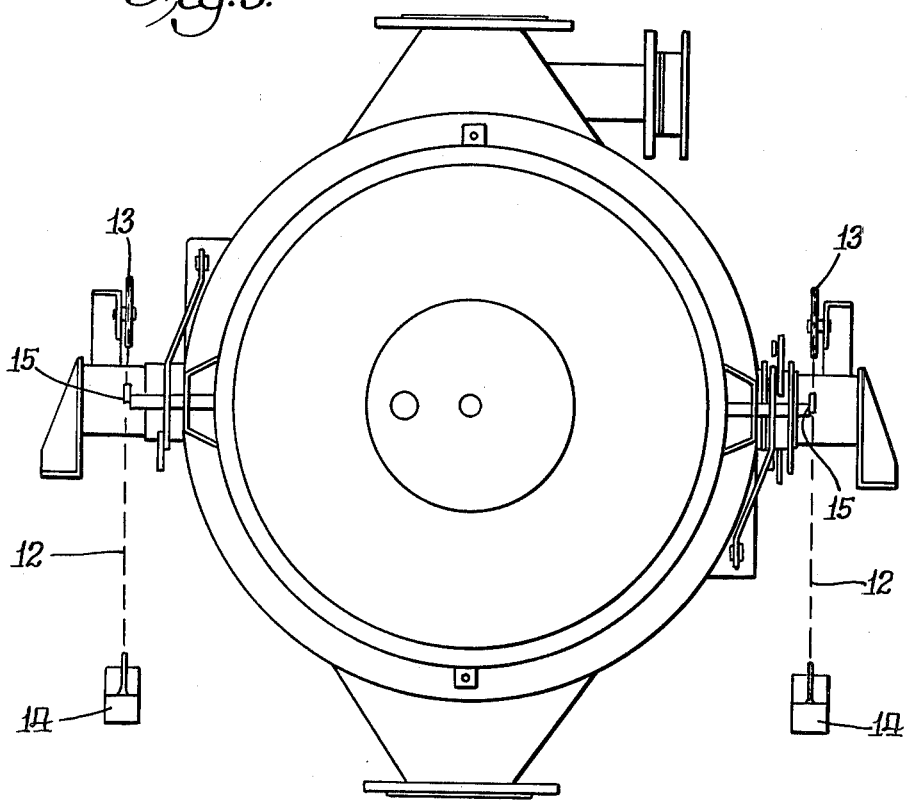
Figure 2A:
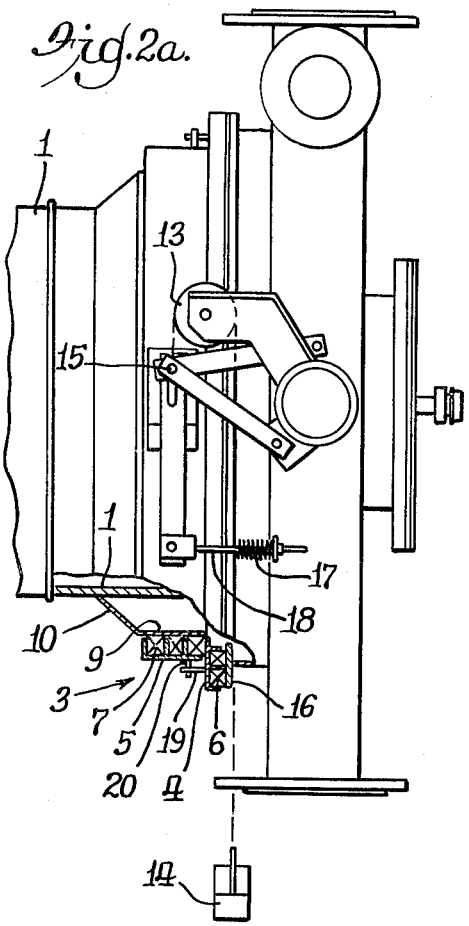
Figure 2B:
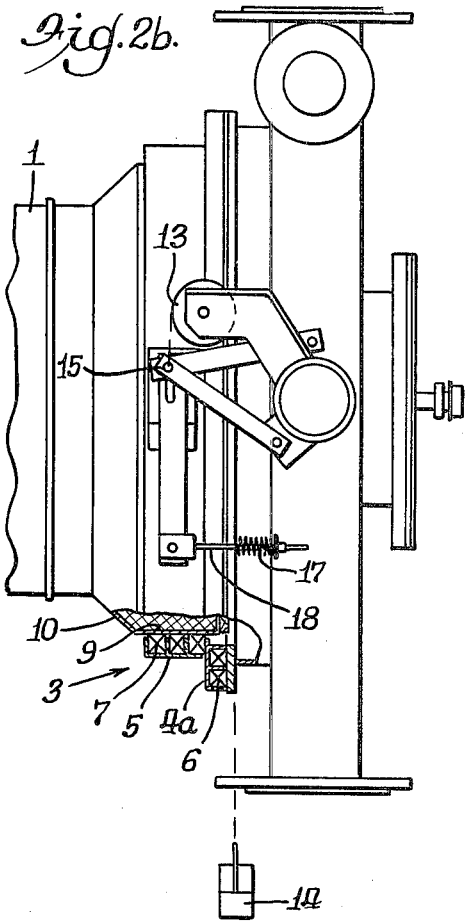

Below, one embodiment of the present invention is explained in greater detail by referring to the enclosed drawings, wherein:

FIG. 1 is a schematical sectional view of a rotary tubular kiln provided with the sealing elements according to the invention;

FIGS. 2*a* and 2*b* are each a sectional view of one of the sealing ring elements; and FIG. 3 is a side elevational view of the sealing ring elements as shown in FIG. 2*a*.

Figure 4:
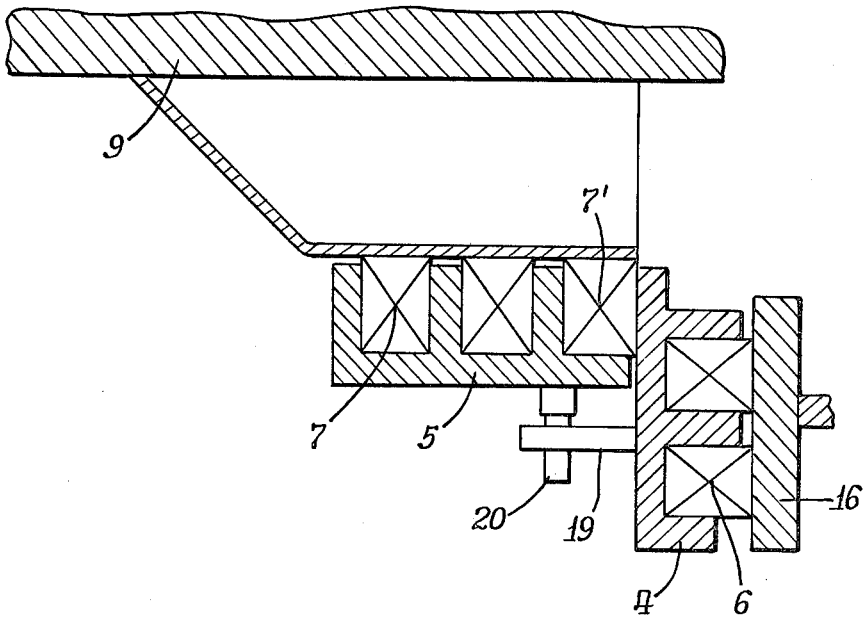

FIG. 4 is an enlarged fractionally sectional view of the sealing elements shown in FIG. 2*a*.

As shown in the figures, the sealing elements are applied to conventional rotary tubular kilns of the type in question and comprising a rotary tube or cylinder 1 and a casing 2, with the casing 2 including an inlet (feed) portion 2*a*, a combustion chamber 2*b* subsequent to the inlet portion in the mass flow direction, and an outlet (discharge) portion 2*c*. A total of four sealing ring elements 3 are positioned in the transition areas between the inlet portion 2*a* and the cylinder 1, between the cylinder 1 and the inlet end of the combustion chamber 2*b*, between the rear end of the combustion chamber 2*b* and the adjacent part of the cylinder 1, and again, between the cylinder 1 and the outlet portion 2*c*, respectively. The cylinder 1 as such includes a conventional mounting assembly 8 composed of a ring 8*a* and stationary rotatable rollers 8*b* wherein the cylinder, under the guiding action of the rings 8*a*, is adapted to be driven in rotation by suitable means (not shown).

As shown in FIG. 2*a*, the sealing ring elements include a radially extending sealing ring 4 acting to press together in axial direction the sealing packings 6 housed therein, as well as an axially extending sealing ring 5 adapted to press together in radial direction the packings 7 mounted therein. The packings are formed of a suitable material, such as, for instance, carbon, graphite, mixtures of asbestos and the like. Rings 4 and 5 contain the packings in the form of stacks or piles; alternatively, partition webs may be provided between them.

Each sealing ring element 3 includes bolts or studs 15 arranged in opposing relationship on a horizontal plane and which bolts are engaged by a cable 12 passing over a sheave 13; the cable 12 is loaded by weights to take up the weight of the sealing ring elements 3 such that weight loading of the cylinder and, thus, unilateral stress of the seals are avoided. Accordingly, perfect weight counter balance is present which is controllable by means of the variable magnitude of weights 14 without impeding movement of the sealing ring elements; furthermore, such counterbalance is independent of position according to the wellknown rule relating to the suspension with the aid of counterweights. Additionally, the sealing ring elements 3 are engaged by drawbars 18 which are biased by springs 17 and which extend in parallel with the cylinder axis such that ring 4 is axially pressed into contact through ring 5. Rings 4 are provided with bolts (studs) 19 which are fitted with clearance into anchoring or draw discs 20 of rings 5 so as to provide a mounting arrangement allowing for some degree of inherent movability. Naturally, springs and weight-loaded cables are almost equivalents for the present purpose and, therefore, interchangeable.

The sealing elements according to the invention, owing to their weight counterbalance, their pressure contact with each other and with their mating surfaces, as well as their movability, provide a maximum efficiency with respect to the sealing function as well as minimum wear.

In order to further improve the sealing function, sealing may be effected not directly with respect to the surface of the cylinder; rather, auxiliary ring elements may be attached to the cylinder, with the cylindrical portion 9 of such ring elements being connected to the cylinder proper through a conical portion 10. As the wall thickness of the conical portion may be much smaller than that of the cylindrical portion, the ring or the cylinder, respectively, is free to move to a given degree, thereby to provide improved fit and peripheral expansion of the cylinder without affecting the sealing surfaces. Thermal insulation may be provided between rings 9, 10 and cylinder 1; the thermal "bridge" of the conical portion 10 has a low degree of conductivity only because of the small wall thickness. By omitting the conical portion 10, however, the cylindrical portion of ring 9 may be directly connected to the cylinder 1 through a heat insulation layer.

As shown in FIG. 2*b*, in a less advantageous embodiment the sealing ring element 3 may also only comprise the ring 5 with the packings 7 received thereby, since in such case the outer surface 4*a* of ring 5 forms the radially extending sealing contact or counter surface, and the packings 6 are mounted stationarily to the casing. Thus, it is possible that the ring in the radially extending seal unit both receives the packings and, alternatively, forms the sealing contact surface. However, this latter construction is disadvantageous if angular displacement in the sealing surfaces or non-uniform expansion occur, because this construction provides a less favorable adjustment or fitting. As before, however, of importance are the pressure contact by ring 5 as well as the separation between the radially and axially extending sealing surfaces in such a manner that the sealing ring element, although substantially fixed in axial direction, has some freedom of movement in radial direction.

The great variations in length accompanying the heating of the rotary tube or cylinder are absorbed because the sealing surface or the cylinder surface, respectively, or the surface of the auxiliary ring 9 are free to shift within packings 7, such that no forces are produced in the sealing area and the effectiveness of the seal is not affected by any length variation of the cylinder. Such shifting or displacement is further facilitated by the fact that the friction produced in shifting in axial direction is negligibly low due to the rotation of the cylinder. In this fashion, any variation of length amounting to about 18 mm per meter of cylinder length at a reference temperature of about 1000° C. relative to room temperature may be absorbed (compensated) without any difficulty.

The variations in length produced across the circumference of the cylinder, i.e. diameter variations in the present instance, are significant, too. These variations are also substantial with respect to the differences in circumferential lengths between the cylinder as such and the auxiliary tube 9 which shows differences of about 3 mm at a differential temperature of about 200° C., which differences must be taken up by the conical portion 10.

Of course, the circumferential expansions of the sealing ring element 3 and the tube 9 are not equal, because a substantial temperature difference exists between these elements. At this place, the sealing effect must be optimized by suitably dimensioning the parts of the rotary tube or cylinder.

In another embodiment of the invention, radiation shields or shielding tube portions may be provided in the vicinity of the inlet portion 2*a* and the outlet portion 2*c*, such that the temperature is automatically decreased in these regions and the auxiliary tube 9 including the mounting means 10 thereof need no longer be used. Sealing can be effected in this case, for example, relative to a tube section mounted by means of a flange to the rotary tube or cylinder proper, and a thermally insulating packing may be further provided between such flanges.

What we claim is:

1. In a rotary kiln having a rotatable cylinder, a sealing system, comprising:

sealing ring means being arranged in concentric relation to said cylinder, said sealing rings means comprising a radially extending sealing ring, first packings of heat resistant and slideable material carried by said radially extending sealing ring, for abutting radially extending surfaces, said radially extending sealing ring pressurizing said first packings in an axial direction against the radially extending surfaces, an axially extending sealing ring, second packing of heat resistant and slideable material carried by said axially extending sealing ring for abutting axially extending surfaces, said axially extending ring pressing said second packings against the axially extending surfaces, mounting means taking up the weight of said radially and axially extending rings and said first and second packings, means extending between said sealing rings and joining the same but allowing selective movement therebetween, and said packings forming a seal between said first and second sealing rings.

2. A sealing system in accordance with claim 1 in which said mounting means comprises cables connected to said ring means, sheaves mounted on a stationary support and having said cables passing thereover, and weights counterbalancing the weight of said ring means connected to said cables.

3. A sealing system in accordance with claim 1, said cylinder having a concentric ring secured to said cylinder to provide an axially extending sealing surface for said second packing means, thermally insulating said concentric ring from said cylinder, said concentric ring being resiliently connected to said cylinder.

4. A system in accordance with claim 3 in which said concentric ring includes a conical portion having a wall thickness substantially smaller than the wall thickness of said cylinder.

5. In a rotary kiln, a sealing system comprising:

a rotatable cylinder having a longitudinal axis, a combustion chamber concentric with said cylinder, an inlet portion adjacent one end of said cylinder, an outlet portion adjacent the other end of said cylinder, a first pair of sealing ring means at said one end of said cylinder with one of said pair of sealing ring means sealing between said inlet portion and said cylinder and the other of said pair of sealing ring means sealing between said cylinder and said combustion chamber, said one and said other of said sealing ring means providing pressure forces acting in opposition to each other;

a second pair of sealing ring means at said other end of said cylinder with one of said sealing rings sealing between said outlet portion and said cylinder and the other of said sealing ring means sealing between said cylinder and said combustion chamber, said sealing ring means providing pressure forces acting in opposition to each other;

each of said sealing ring means comprising:

radially extending sealing rings and first packings of heat resistant and slideable material carried by said radially extending sealing ring for abutting radially extending surfaces, and axially extending sealing rings having second packings of heat resistant and slideable material carried thereby for abutting axially extending surfaces, and mounting means taking up the weight of said sealing rings and the weight of said packings.

* * * * *